United States Patent [19]

Leather

[11] 4,068,611

[45] Jan. 17, 1978

[54] BOAT CONVERSION DEVICE

[76] Inventor: Richard B. Leather, 50 Valley Road, Plandome, N.Y. 11030

[21] Appl. No.: 726,643

[22] Filed: Sept. 24, 1976

[51] Int. Cl.[2] ..... B63H 16/06

[52] U.S. Cl. ..... 115/24.1; 9/7; 114/39

[58] Field of Search ..... 115/24.1, 24.5, 24.6; 114/39; 9/7, 1.1, 2 S

[56] References Cited

U.S. PATENT DOCUMENTS

| | | | |
|---|---|---|---|
| 2,815,517 | 12/1957 | Andresen, Jr. | 115/24.1 X |
| 3,291,088 | 12/1966 | Klose | 114/39 |
| 3,898,950 | 8/1975 | Martin | 115/24.1 |

*Primary Examiner*—Barry L. Kelmachter

[57] ABSTRACT

The disclosed device provides a rowing capability to an off-the-beach type sailing vessel having a hull including a top surface and a recess, such as for example a footwell or center board opening, formed therein. The device includes a horizontally extending seat surface, and an insert member connected to the seat member and received in one of the vessel's recesses, thereby to secure the seat surface to the vessel. The insert member includes a pair of oppositely extending outrigger support structures respectively having oar locks mounted therein for receiving a rowing oar. When the insert is positioned in the hull recess the vessel can be rowed by a person seated on the device of the invention.

38 Claims, 9 Drawing Figures

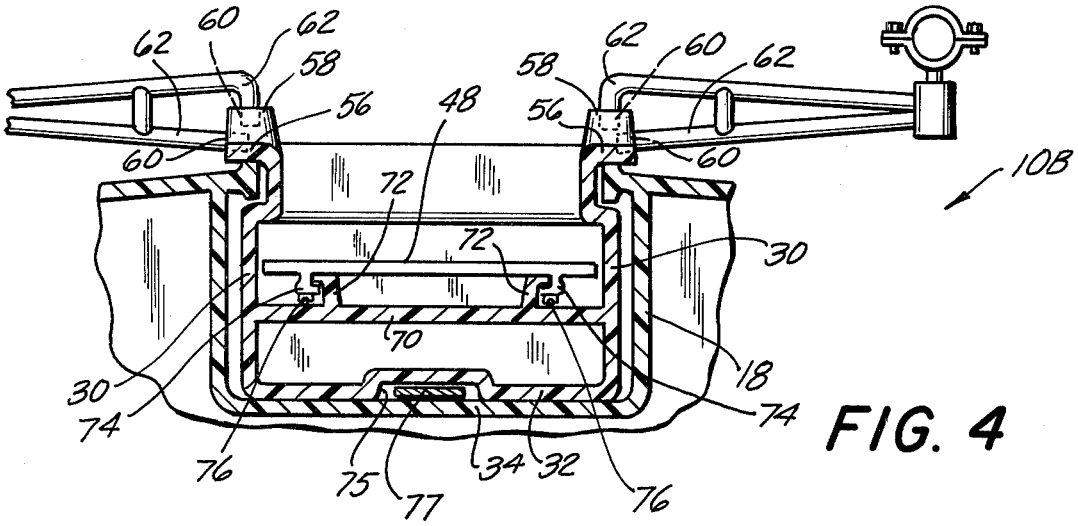
FIG. 4
FIG. 6
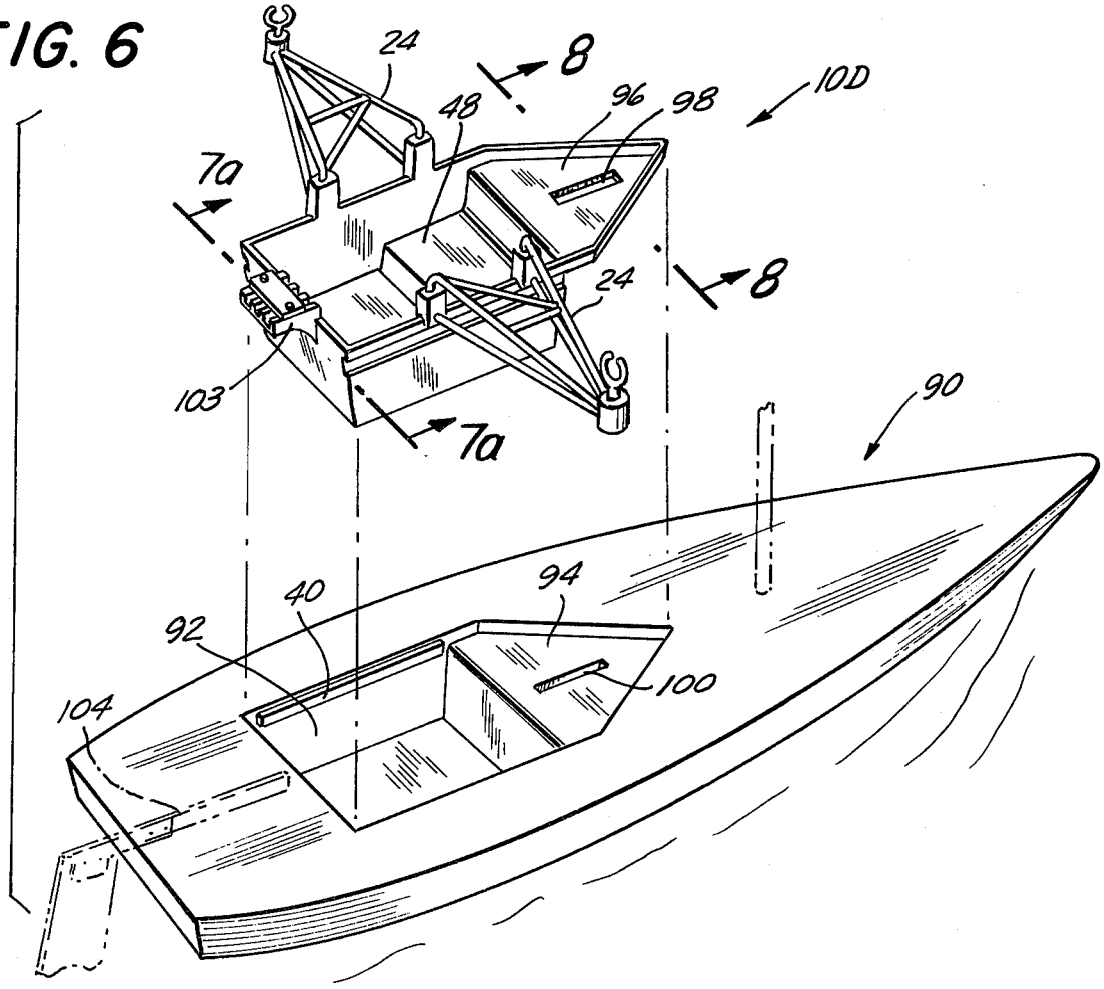

FIG. 5
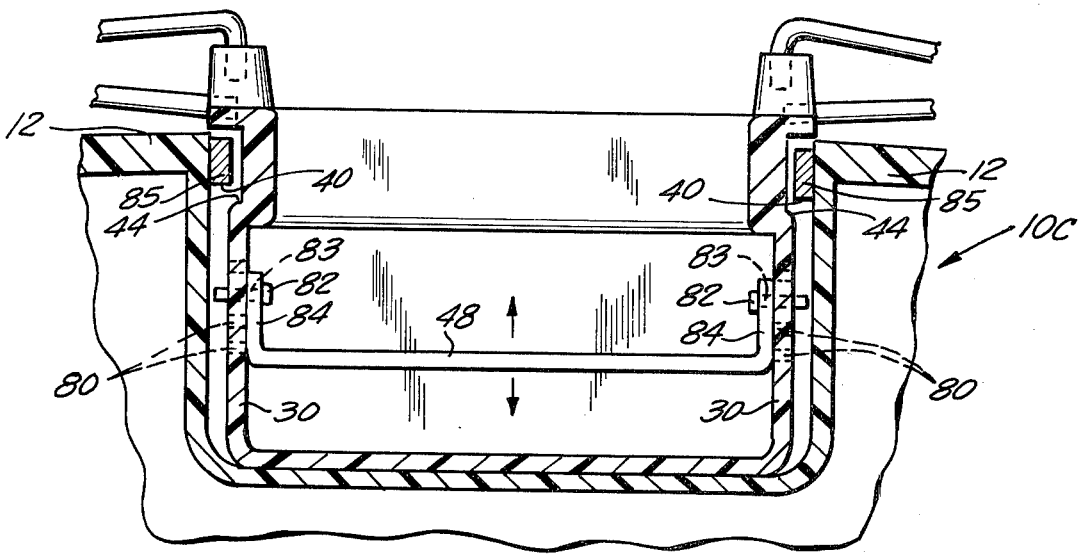
FIG. 7a
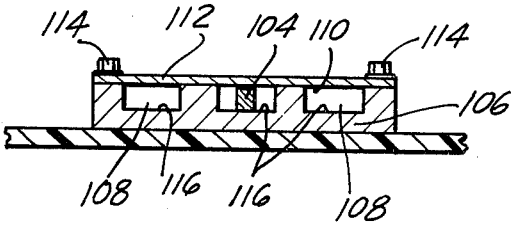
FIG. 7b
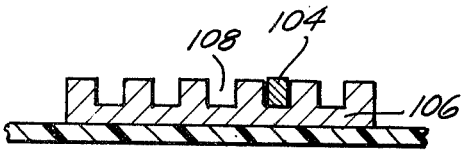
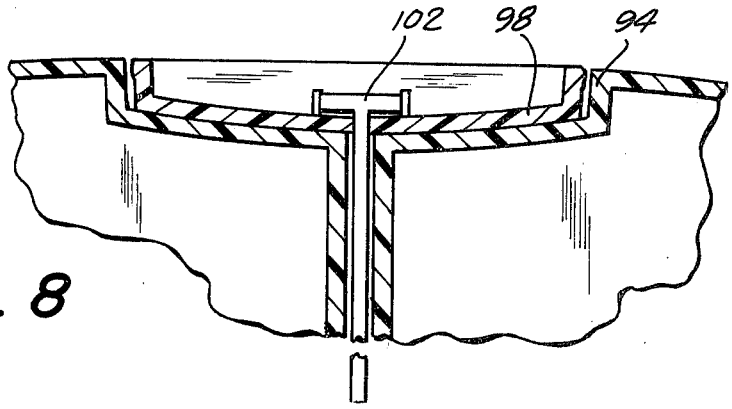
FIG. 8

BOAT CONVERSION DEVICE

The present invention relates to conversion devices for boats, and in particular to a device for converting an off-the-beach board type sailing vessel to a vessel having rowing capability.

There is an ever increasing popularity in recent years for off-the-beach type board boats of the well known Sunfish or Laser type boat which has an unsinkable flat hull and is typically operated solely by one or two persons. The top surface or deck of the these vessels is usually fairly relatively flat and generally has a square or rectangular recess or foot-well so that the persons operating the boat when sailing normally sit on the hull with their feet in the well. In addition such vessels also include an opening or recess for receiving a center board, and an additional opening for mounting the lower end of the mast.

Boats of this type are of great interest to individuals, yacht clubs, and athletic organizations and especially to camps where sailing and rowing are taught. However, as presently manufactured and sold such boats have limited use since they are solely intended as sailing vessels. On the other hand the hull structures of these boats have excellent stability and floating characteristics which are desirable in safety minded programs such as the above mentioned groups are interested in. Accordingly, it would be useful to enable the hulls of these vessels to be used for teaching rowing, in addition to sailing, and to also permit them to serve as fishing platforms for lakes or other areas where conventional rowboats are favored.

Thus, it is an object of the present invention to provide a conversion unit which can easily and rapidly convert a board type sailing vessel to a vessel having rowing capability.

Another object of the present invention is to provide a conversion unit of the character described which is relatively inexpensive to manufacture.

A still further object of the present invention is to provide a conversion unit of the character described which is of light weight and easily and rapidly connected to the hull of the vessel with which it is to be used.

In accordance with an aspect of the present invention, a conversion unit is provided for use with an off-the-beach type sailing vessel having a hull including a top surface or deck with a footwell formed therein. The conversion unit provides rowing capability to the vessel and includes a molded shell having a peripheral configuration which is generally complementary to the configuration of the footwell in order to be received in the footwell in a relatively tight mounting arrangement. If desired a snap fitting arrangement can be provided depending upon the configuration of the footwell. The molded shell includes a horizontal seating surface connected thereto, either integrally molded with the shell or otherwise secured to the shell for adjustment or sliding movement, as described hereinafter. And, the shell is provided with a pair of oppositely extending outrigger support structures extending transversely of the longitudinal axis of the vessel's hull. These outriggers respectively include oar locks mounted therein for receiving a rowing oar. With the shell mounted in the vessel's hull in this manner a person can sit on the seating surface provided by the shell and row the vessel. Of course, with the conversion unit of the present invention inserted in the hull it is desirable to remove the mast and sail of the vessel since they are unnecessary when the boat is being rowed.

The above, and other objects, features and advantages of this invention will be apparent in the following detailed description of several illustrative embodiments thereof, which is to be read in connection with the accompanying drawings, wherein:

FIG. 4 is a transverse sectional view, similar to FIG. 2, of a further embodiment of the present invention;

FIG. 5 is a sectional view, similar to FIG. 4, of a still further embodiment of the present invention;

FIG. 6 is an exploded perspective view showing yet another embodiment of the invention used in conjunction with a Laser type sailing vessel;

FIG. 7A is a sectional view taken along line 7A—7A of FIG. 6 of a tiller locking structure;

FIG. 7B illustrates a modification of the tiller locking structure shown in FIG. 7A; and FIG. 8 is a sectional view taken along line 8—8 of FIG. 6.

Figure 1:
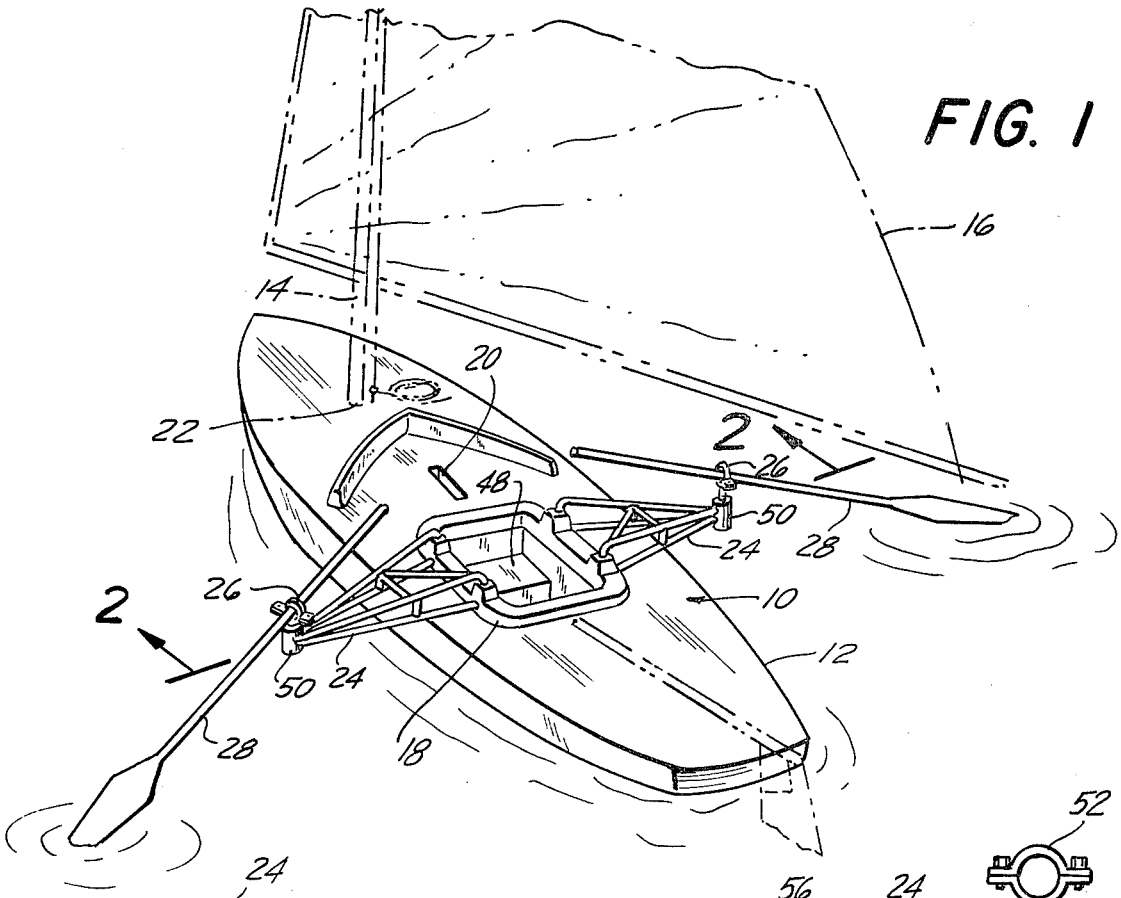
FIG. 1 is a perspective view of an off-the-beach type sailboat having a conversion unit constructed in accordance with the present invention mounted therein.

Referring now to the drawing in detail, and initially to FIG. 1 thereof, it is seen that a conversion unit 10, constructed in accordance with the present invention, is mounted in the hull 12 of a Sunfish type sailing vessel. As is well known Sunfish type sailing vessels, i.e., vessels of the off-the-beach board type, have relatively hard buoyant hulls to which a mast 14 and sail 16 are removably mounted. In the drawings, the mast and sail are shown in dotted lines, since they are not part of the invention, and are not used when conversion unit 10 is mounted in hull 12.

These hulls typically have a footwell 18 which, in the illustrative embodiment, contains the conversion unit 10 of the present invention, as well as a center board opening or recess 20, and a cylindrical recess 22 for receiving the lower end of mast 14. As mentioned, vessels of this type have very good stability and buoyancy, and will give very satisfactory performance when provided with a rowing capability.

Conversion unit 10 is adapted to be securely mounted to hull 12 of the vessel, as described hereinafter, in order to provide a seating surface as well as a pair of oppositely extending outrigger structures 24 in which oar locks 26 are mounted for receiving rowing oars 28. The conversion unit is removably mounted in the hull of the vessel so that the vessel can be used either as a rowing unit or as a sailboat.

Figure 2:
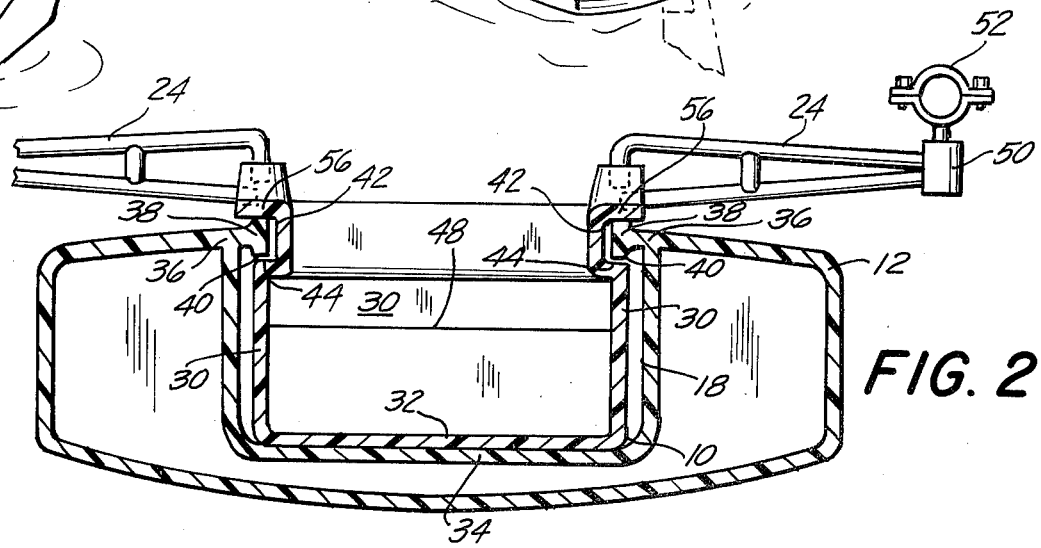
FIG. 2 is a transverse sectional view taken along line 2—2 of FIG. 1.

Conversion unit 10 is illustrated in detail in FIG. 2, wherein it is seen that the unit consists of a generally rectangular hollow shell having side walls 30 and a bottom wall 32. The peripheral configuration of the conversion unit as defined by side walls 30 and bottom wall 32 is generally complementary to the peripheral configuration of the footwell 18 in hull 12, so that bottom wall 32 typically rests on the bottom of the footwell.

In Sunfish type sailing vessels the upper edge portion 36 of the footwell 18 is usually provided with an inwardly extending bead or rim 38, which is used as a hand hold or toe hold during sailing. This rim provides a downwardly facing shoulder 40 which is advantageously used in conjunction with the present invention to removably secure the conversion unit 10 in the footwell. Thus, side walls 30 are provided with recesses 42 formed along their upper ends in a generally complementary configuration to rim 38 so that the recesses provide upwardly facing shoulders 44 which are generally complementary to shoulders 42. Since the conversion unit is preferably formed of a molded plastic or fiberglass material, and while it is relatively rigid it will have some flexibility, the conversion unit can snap fit into footwell 18 to position shoulders 40, 44 in juxtaposition thereby to prevent inadvertent removal of the shell from the hull.

In the illustrative embodiment of the invention shown in FIG. 2 conversion unit 10 includes a horizontal seating surface 48 molded integrally therein within the confines of side walls 30, in order to permit a person rowing the boat to sit within the footwell. If desired however the person using the embodiment of the invention shown in FIG. 2 could sit on hull 12 of the vessel with solely his feet on the surface 48 or in footwell 18. Preferably seat 48 is located in the conversion unit so that the operator faces aft of the vessel when rowing.

The outrigger structures 24, in the embodiment of the invention illustrated in FIG. 2, are integrally molded with the shell conversion unit 10. Each outrigger is formed of a plurality of interconnected rods arranged in a manner similar to the outriggers used in conventional sculls and has an integral feral or mounting bearing 50 at its end. This feral is adapted to rotatably receive a conventional oar lock 52 which in turn receives an oar 28 to permit the operator to row the vessel. By this construction a relatively simple conversion unit is provided which can be easily inserted in the footwell of the vessel to provide outrigger support for the oar locks in order to enable an operator to row an off-the-beach type sailing vessel, such as for example a Sunfish or Laser boat.

Figure 3:
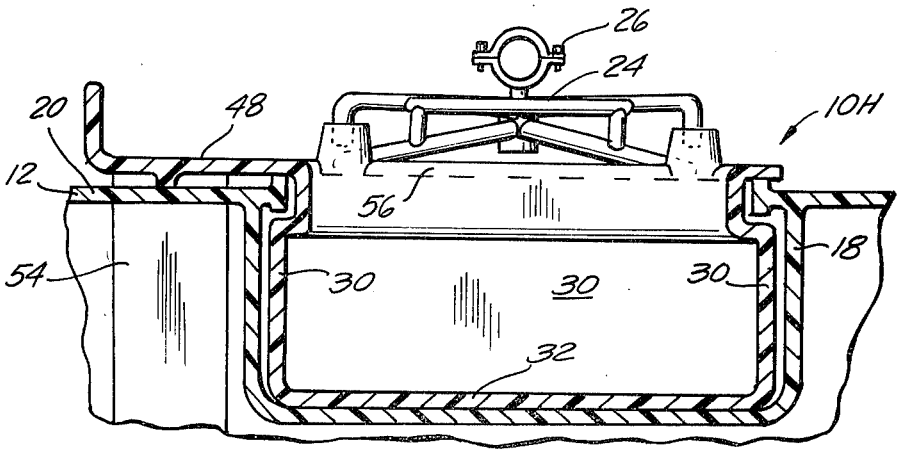
FIG. 3 is a longitudinal sectional view of a conversion unit constructed with another embodiment of the present invention.

Another embodiment, 10A, of the present invention is shown in FIG. 3, wherein the conversion unit is illustrated in longitudinal cross-section. In this case the conversion unit is provided with side walls 30 and bottom wall 32 in the same manner as previously described. However, instead of locating seating surface 48 within the confines of side walls 30, the seating surface is formed as an integral extension overlying hull 12 of the vessel adjacent the center board opening 20 therein. This permits the entire footwell area 18 of the vessel to remain open and free, for the operator's feet, or for storage.

In addition, it is contemplated that, if desired, conversion unit 10A may be provided with an integrally molded center board or plate 54 which will extend through the center board opening 20 of the hull. The center board 54 can have any desired length, to aid in the directional stability of the boat during movement. In addition it also serves to stabilize the conversion unit on the hull of the structure.

It is also contemplated that, according to yet another embodiment of the invention, conversion unit 10A illustrated in FIG. 3 can consist simply of seat 48 and the center board 54, without the side walls 30 and bottom wall 32 of the shell located within the footwell. It will be appreciated that the center board 54 will locate the seating surface 48 on the shell in the desired position and will hold the seating surface in a fixed position. In this embodiment of the invention outrigger members 24 would be integrally molded with seat 48, and it is contemplated that the outriggers will be connected to seat 40 simply by the top flanges 56 of the shell structure, which would overlie the upper peripheral portion of the footwell. But, in this embodiment at least the lower portions of the side walls 30 and the bottom wall 32 would not be provided.

Another embodiment, 10B, of the conversion unit of the present invention is illustrated in FIG. 4. This embodiment is similar to the embodiment shown in FIG. 2 in that the conversion unit includes integrally molded side walls 30 and a bottom wall 32 which rests on the bottom wall 34 of the footwell 18. However the upper flanges 56 of the conversion unit includes bosses 58, similar to the unnumbered bosses shown in the embodiment of the invention of FIG. 2, which have apertures 60 formed therein for removably receiving the end portions 62 of the outrigger support structures. That is, it may be desirable that the outrigger structures, for compactness in shipment and the like, be separately formed units either of molded plastic or of metal such as aluminum. In that case the shell for the conversion unit 10 is provided with bosses 58 which are adapted to removably receive the ends of the outrigger structures in any convenient manner. Once the ends of the outrigger structures are received in the appropriate aperture 60 of the bosses 58 they can be locked therein either by a friction fit, such as illustrated in FIG. 4, or by any other convenient arrangement, such as for example set screws or the like. This feature of the invention of course can be used with the other embodiments of the invention illustrated in the other figures of the drawings herein.

In addition, in this embodiment of the invention seating surface 48 is movably mounted on conversion unit 10B in order to permit a sliding movement to the seat, to facilitate rowing in the manner usual for sculls. While the sliding mounting of the seat 48 can take any desired form, in the illustrative embodiment of the invention it is seen that unit 10B includes a horizontal support wall 70 integrally molded therein, including a pair of upwardly extending flanges 72. Seating surface 48 has a pair of downwardly extending flanges 74 captured beneath flanges 72 and supported by rollers or bearings 76, in any convenient manner, on surface 70. This will permit free sliding movement of seating surface 48 in a fore and aft direction during rowing by the operator. Again, it is contemplated that this movable seating arrangement can be used with any embodiments of the invention illustrated in the drawings herein, and the specific slide mechanism can take several different forms.

In addition, in the embodiment of FIG. 4, the bottom wall of the shell has a step or hump 75 formed therein to accommodate the hiking strap 77 that is usually provided in the bottom on the footwell of boats of the type with which this invention is concerned.

In FIG. 5 of the drawing a still further embodiment of the invention, 10C is illustrated, wherein the seating surface 48 is adjustably mounted for vertical movement with respect to the shell. This embodiment of the invention is similar to the embodiment of FIG. 2, wherein the seating surface is located within the confines of the walls 30 of the shell. However, in this case the lateral side walls 30 of the shell have a plurality of apertures 80 formed therein, which are adapted to receive connecting bolts 82 secured in the upwardly extending side flanges 84 of seating surface 48. After shell 10C is mounted in the hull of the vessel, the seating surface 48 is mounted in the shell by positioning the holes 73 in seating surface flanges 84 in alignment with selected opposed pairs of apertures 80 in shell walls 30 and then inserting bolts 82 therein. The bolts will hold the seating surface on the side walls 80 by frictional engagement or, if desired, these bolts can be provided as integral pins in the side flanges 84, and which will then simply be snap fit in the apertures 80 when the seating surface is properly positioned. Again, this arrangement of the invention can be used with any of the previously proposed embodiments.

The hull 12 shown in FIG. 5 is a Laser type hull where, instead of a molded rim on the upper edge of the footwell a pair of wood strips 85 are secured to the side walls of the footwell to serve as toe or hand holds. These strips provide shoulders 40 for cooperation with the shoulders 44 of the shell as in the previously described embodiment.

A still further embodiment, 10D, of the invention is illustrated in FIG. 6 of the drawing. In this embodiment, the conversion unit is also adapted for use with a Laser type sailing vessel 90. This type of vessel has a somewhat larger footwell 92, and includes a well extension 94 forwardly of the footwell 92. In this embodiment of the invention conversion unit 10D is integrally molded, in a manner similar to the conversion unit 10 of FIGS. 1 and 2, but includes an extension portion 96 which is generally complementary to the recess extension 94 of vessel 90. And, the conversion unit provides an integral molded seating surface 48 as well as integral outrigger extensions 24 as in the previously discussed embodiments.

In addition, extension 96 includes an opening 98 which is located to align with center board opening 100 of the vessel. This opening permits the center board 102 of the vessel to be inserted through the extension 98 of the conversion unit to aid in directional stability of the vessel during the rowing operation. In addition center board 102 aids in locking the conversion unit in the desired fixed position.

As an additional feature of the present invention, which is useful with each of the embodiments of the present invention, the conversion unit 10D is provided with an integral extension portion 103 which is adapted to aid the operator in controlling the tiller of the sailing vessel. As is well known these board type sailing vessels all include a rudder and tiller arrangement which includes an elongated tiller arm 104. Obviously, when the operator is rowing the boat it is difficult to simultaneously control the tiller. However, extension 103 of the present invention permits the operator to set the tiller in a desired position and automatically hold the tiller in that position. As seen in FIG. 7A, this extension portion includes a transverse elongated bar 106 having a plurality of upwardly opening slots 108 formed therein. The open upper ends 110 of these slots is closed by a transverse bar 112 secured by bolts 114 or the like to the ends of bar 106. The height of slots 108 is selected to be substantially equal to the height of tiller arm 104 so that the tiller arm is frictionally held in the slot between the base 116 of the slot and bar 112. By this arrangement if the operator desires to make an adjustment of the position of the tiller, he can do this by simply pushing the tiller in the desired direction in the slot in which it is located by using his foot without stopping the rowing operation. Because of the frictional engagement of the tiller in slot 108 it will remain in the position in which it is pushed or pulled by the operator.

Where the ability to make fine adjustments in the position of the tiller is not required bar 106, as seen in FIG. 7, need not be provided with elongated slots 108 but, rather, each of the slots can be dimensioned simply to grip tiller 104 tightly therein, as by friction fit, so that the operator can simply manually move the tiller from one slot to another, with the tiller being held in position in the slot to which it is moved by the tight clamping arrangement provided by the friction fit of the slots 108.

While the tiller control extension 103 is shown in the drawings as being laterally molded with conversion unit 10D, it is contemplated that the control unit can be a separate member which is secured to the hull of the vessel in any convenient manner. Again, this control unit can be used with any of the previously described embodiments of the invention.

Accordingly, it is seen that a relatively simply constructed conversion unit is provided which will permit a board type sailing vessel to be rapidly and conveniently converted to a vessel having rowing capability. The conversion unit is relatively simply constructed and will be durable in use. It will also be relatively simple and inexpensive to manufacture.

Although illustrative embodiments of the present invention have been described herewith with reference to the accompanying drawings, it is to be understood that the invention is not limited to those precise embodiments thereof but that various changes and modifications may be effected therein by one skilled in the art without departing from the scope or spirit of this invention.

What is claimed is:

1. A device for use in a sailing vessel, having a footwell, to provide rowing capability to the vessel, said device comprising a one piece molded shell adapted to be mounted in the footwell of said sailing vessel and including means for providing a generally horizontal seating surface therein, and a pair of oppositely extending outrigger support structures operatively connected to said shell, each of said support structures including an oar lock mounted therein for receiving a rowing oar; and said means for providing a seating surface comprising an integral seat molded in said one piece shell.

2. A device as defined in claim 1 wherein said seat comprises an extension of said shell overlying a portion of the hull of the vessel adjacent said footwell.

3. A device as defined in claim 1 wherein said seat is located within the confines of said shell to be within the footwell of said vessel.

4. A device as defined in claim 1 wherein said outrigger structures are integrally formed with said shell.

5. A device as defined in claim 1 wherein said outrigger structures are removably mounted in said shell.

6. A device as defined in claim 1 wherein said shell has a peripheral configuration which is generally complementary to the peripheral configuration of the footwell of the vessel.

7. A device for use in a sailing vessel, having a footwell, to provide rowing capability to the vessel, said device comprising a shell adapted to be mounted in the footwell of said sailing vessel and including means for providing a generally horizontal seating surface therein, and a pair of oppositely extending outrigger support structures operatively connected to said shell, each of said support structures including an oar lock mounted therein for receiving a rowing oar; said vessel including a tiller and said device including means for adjustably holding said tiller in a selected fixed position with respect to the hull of the vessel.

8. A device as defined in claim 7 wherein said adjustable holding means includes a support member having a plurality of upwardly opening slots formed therein for selectively receiving said tiller.

9. A device as defined in claim 8 wherein said slots have a width dimension, transverse of the longitudinal axis of the vessel which is greater than the width dimenion of the tiller, and said holding means includes means mounted on said support member across the open end of said slots for frictionally holding the tiller in a relatively fixed position in a selected one of said slots.

10. A device for use in a sailing vessel, having a footwell, to provide rowing capability to the vessel, said device comprising a shell adapted to be mounted in the footwell of said sailing vessel and having a peripheral configuration which is generally complementary to the peripheral configuration of the footwell of said vessel; said shell including means for providing a generally horizontal seating surface therein, and a pair of oppositvely extending outrigger support structures operatively connected to said shell, each of said support structures including an oarlock mounted therein for receiving a rowing oar; said footwell including a bottom wall and said shell including a bottom wall resting on the bottom wall of the footwell.

11. A device as defined in claim 10 including means for slidably mounting said horizontal seating surface in said shell for sliding movement in a fore and aft direction with respect to the vessel's hull.

12. A device as defined in claim 10 including means for adjustably mounting said seating surface in said shell.

13. A device for use in a sailing vessel, having a footwell, to provide rowing capability to the vessel, said device comprising a shell adapted to be mounted in the footwell of said vessel and including means for providing a generally horizontal seating surface therein, and a pair of oppositely extending outrigger support structures operatively connected to said shell, each of said support structures including an oarlock mounted therein for receiving a rowing oar; said vessel including means for defining downwardly facing shoulders in said footwell and said shell including generally complementary upwardly facing shoulders snap fitting beneath said downwardly facing shoulders of the vessel to secure the shell in the vessel.

14. A device for use in a sailing vessel, having a footwell, to provide rowing capability to the vessel, said device comprising a shell adapted to be mounted in the footwell of said vessel and including means for providing a generally horizontal seating surface therein, and a pair of oppositely extending outrigger support structures operatively connected to said shell, each of said support structures including an oarlock mounted threin for receiving a rowing oar; said vessel having a center board opening therein and said shell including an integral center board adapted to extend through said opening.

15. A device for use in a sailing vessel, having a footwell, to provide rowing capability to the vessel, said device comprising a shell adapted to be mounted in the footwell of said vessel and including means for providing a generally horizontal seating surface therein, and a pair of oppositely extending outrigger support structures operatively connected to said shell, each of said support structures including an oarlock mounted therein for receiving a rowing oar; said vessel having a center board opening therein and said shell having an extension portion overlying the hull of the vessel adjacent said center board opening, said extension including an opening therein aligned with said center board opening to permit a center board to be inserted therethrough.

16. A device for use in an off-the-beach type sailing vessel having a hull including a top surface and a recess formed therein, said device providing rowing capability to the vessel and comprising a horizontal seating surface, connecting means connected to said seating surface and adapted to be inserted in said recess for securing said seating surface to said hull, and pair of oppositely extending outrigger support structures operatively secured to said connecting means, said outrigger support structures each including an oar lock mounted thereon for receiving a rowing oar; said recess in the vessel's hull comprising a recess for receiving the center board of the vessel and said connecting means comprising an integral extension of the seating surface adapted to be received in said center board.

17. A device for use in an off-the-beach type sailing vessel having a hull including a top surface and a recess formed therein, said device providing rowing capability to the vessel and comprising a horizontal seating surface, means connected to said seating surface and adapted to be inserted in said recess for securing said seating surface to said hull, and a pair of oppositely extending outrigger support structures operatively secured to said connecting means, said outrigger support structures each including an oarlock mounted thereon for receiving a rowing oar; said recess in said hull comprising a footwell and said connecting means comprising a shell having a peripheral configuration which is generally complementary to said footwell and adapted to be received therein; said seating surface comprising an integral extension of said shell overlying a portion of the hull of the vessel adjacent the footwell.

18. A device for use in an off-the-beach type sailing vessel having a hull including a top surface and a recess formed therein, said device providing rowing capability to the vessel and comprising a horizontal seating surface, means connected to said seating surface and adapted to be inserted in said recess for securing said seating surface to said hull, and a pair of oppositely extending outrigger support structures operatively secured to said connecting means, said outrigger support structures each including an oarlock mounted thereon for receiving a rowing oar; said seating surface, connecting means and outrigger support structures being of one piece molded construction.

19. A device as defined in claim 18 wherein said recess in the vessel's hull comprises a footwell and said connecting means comprises a shell having a peripheral configuration which is generally complementary to said footwell and adapted to be received therein.

20. A device as defined in claim 18 wherein said seating surface comprises an integral seat located within the confines of said shell to be within the footwell of said vessel.

21. A device for use in an off-the-beach type sailing vessel having a hull including a top surface and a recess formed therein, said device providing rowing capability to the vessel and comprising a horizontal seating surface, means connected to said seating surface and adapted to be inserted in said recess for securing said seating surface to said hull, and a pair of oppositely extending outrigger support structures operatively secured to said connecting means, said outrigger support structures each including an oarlock mounted thereon for receiving a rowing oar; said seating surface and connecting means being of one piece molded construction and said outrigger support structures being removably connected thereto.

22. A device for use in an off-the-beach type sailing vessel having a hull including a top surface and a recess formed therein, said device providing rowing capability to the vessel and comprising a horizontal seating surface, means connected to said seating surface and adapted to be inserted in said recess for securing said seating surface to said hull, and a pair of oppositely extending outrigger support structures operatively secured to said connecting means, said outrigger support structures each including an oarlock mounted thereon for receiving a rowing oar; said vessel including a tiller and said device including means for adjustably holding said tiller in a selected fixed position with respect to said hull.

23. A device as defined in claim 22 wherein said connecting means includes means slidably connected to said seating surface to permit said seating surface to slide in a fore and aft direction with respect to the vessel's hull.

24. In an off-the-beach type sailing vessel having a hull including a top surface and a recess formed therein, a device for providing a rowing capability to the vessel, comprising a horizontally extending seating surface, means received in said vessel for connecting the seating surface to the hull and a pair of oppositely extending outrigger support structures operatively secured to the connecting means, said outrigger support structures each including an oarlock mounted thereon for receiving a rowing oar; said connecting means including a molded insert having a peripheral configuration which is generally complementary to the peripheral configuration of the recess of the hull, and said seating surface and insert being of one piece molded construction.

25. A device as defined in claim 24 wherein said outrigger structures are removably mounted on said insert.

26. In an off-the-beach type sailing vessel having a hull including a top surface and a recess formed therein, a device for providing a rowing capability to the vessel, comprising a horizontally extending seating surface, means received in said vessel for connecting the seating surface to the hull and a pair of oppositely extending outrigger support structures operatively secured to the connecting means, said outrigger support structures each including an oarlock thereon for receiving a rowing oar; said connecting means including a molded insert having a peripheral configuration which is generally complementary to the peripheral configuration of the recess in the hull and means for adjustably securing said seating surface to said insert to permit vertical adjustment of the seating surface with respect to the insert.

27. In an off-the-beach type sailing vessel having a hull including a top surface and a recess formed therein, a device for providing a rowing capability to the vessel, comprising a horizontally extending seating surface, means received in said vessel for connecting the seating surface to the hull and a pair of oppositely extending outrigger support structures operatively secured to the connecting means, said outrigger support structures each including an oarlock thereon for receiving a rowing oar; said connecting means including a molded insert having a peripheral configuration which is generally complementary to the peripheral configuration of the recess in the hull; said vessel includes a tiller and said device including means for adjustably holding said tiller in a selected fixed position with respect to said hull.

28. A device as defined in claim 27 wherein said connecting means includes means for slidably connecting said seating surface to said insert to permit said seating surface to slide in a fore and aft direction with respect to the vessel's hull.

29. In an off-the-beach type sailing vessel having a hull including a top surface and a recess formed therein, a device for providing a rowing capability to the vessel, comprising a horizontally extending seating surface, means received in said vessel for connecting the seating surface to the hull and a pair of oppositely extending outrigger support structures operatively secured to the connecting means, said outrigger support structures each including an oarlock thereon for receiving a rowing oar, said connecting means including a molded insert having a peripheral configuration which is generally complementary to the peripheral configuration of the recess in the hull and said vessel including means for defining downwardly facing shoulders in said recess and said insert including generally complementary upwardly facing shoulders fitting beneath said downwardly facing shoulders of the vessel to secure the insert to the vessel.

30. In an off-the-beach type sailing vessel having a hull including a top surface and a recess formed therein, a device for providing a rowing capability to the vessel, comprising a horizontally extending seating surface, means received in said vessel for connecting the seating surface to the hull and a pair of oppositely extending outrigger support structures operatively secured to the connecting means, said outrigger support structures each including an oarlock thereon for receiving a rowing oar, said connecting means including a molded insert having a peripheral configuration which is generally complementary to the peripheral configuration of the recess in the hull and said recess in the hull being a center board opening therein receiving said insert.

31. In an off-the-beach type sailing vessel having a hull including a top surface and a recess formed therein, a device for providing a rowing capability to the vessel, comprising a horizontally extending seating surface, means received in said vessel for connecting the seating surface to the hull and a pair of oppositely extending outrigger support structures operatively secured to the connecting means, said outrigger support structures each including an oarlock thereon for receiving a rowing oar, said connecting means including a molded insert having a peripheral configuration which is generally complementary to the peripheral configuration of the recess in the hull and said recess in the hull being a footwell and said insert comprising a shell having a cross-sectional configuration which is generally complementary to the cross-sectional configuration of the footwell and defines an upwardly opening well having a bottom wall supported on the base of the footwell.

32. In an off-the-beach type sailing vessel having a hull including a top surface and a footwell formed therein, a device for providing a rowing capability to the vessel comprising a molded shell having a peripheral configuration which is generally complementary to the configuration of said footwell and being received and supported in said footwell, a horizontal seating surface secured to said shell and a pair of oppositely extending outrigger support structures connected to said shell, each of said outrigger support structures, including an oar lock mounted therein for receiving a rowing oar; said seating surface and shell being formed as a one piece molded member.

33. A device as defined in claim 32 wherein said seating surface shell and outrigger support structures are molded together in a one piece molded unit.

34. In an off-the-beach type sailing vessel having a hull including a top surface and a footwell formed therein, a device for providing a rowing capability to the vessel comprising a molded shell having a peripheral configuration which is generally complementary to the configuration of said footwell and being received and supported in said footwell, a horizontal seating surface secured to said shell and a pair of oppositely extending outrigger support structures connected to said shell, each of said outrigger support structures including an oarlock mounted therein for receiving a rowing oar; and means for adjustably securing the seating surface to the shell to permit vertical adjustment of the position of the seating surface.

35. In an off-the-beach type sailing vessel having a hull including a top surface and a footwell formed therein, a device for providing a rowing capability to the vessel comprising a molded shell having a peripheral configuration which is generally complementary to the configuration of said footwell and being received and supported in said footwell, a horizontal seating surface secured to said shell and a pair of oppositely extending outrigger support structures connected to said shell, each of said outrigger support structures including an oarlock mounted therein for receiving a rowing oar; said seating surface comprising an extension of said shell overlying a portion of the hull of the vessel adjacent said footwell.

36. In an off-the-beach type sailing vessel having a hull including a top surface and a footwell formed therein, a device for providing a rowing capability to the vessel comprising a molded shell having a peripheral configuration which is generally complementary to the configuration of said footwell and being received and supported in said footwell, a horizontal seating surface secured to said shell and a pair of oppositely extending outrigger support structures including an oarlock mounted therein for receiving a rowing oar; said vessel including a tiller and said device including means for adjustably holding said tiller in a selected fixed position with respect to said hull.

37. In an off-the-beach type sailing vessel having a hull including a top surface and a footwell formed therein, a device for providing a rowing capability to the vessel comprising a molded shell having a peripheral configuration which is generally complementary to the configuration of said footwell and being received and supported in said footwell, a horizontal seating surface secured in said shell and a pair of oppositely extending outrigger support structures including an oarlock mounted therein for receiving a rowing oar; said vessel including means for defining downwardly facing shoulders in said footwell and said shell including generally complementary upwardly facing shoulders snap fitting beneath said downwardly facing shoulders of the vessel to secure the shell in the vessel.

38. A device as defined in claim 37 including means for slidably connecting said seating surface to said shell to permit longitudinal sliding movement of the seating surface in a fore and aft direction.

* * * * *